US008099923B2

(12) United States Patent
Jolitz et al.

(10) Patent No.: US 8,099,923 B2
(45) **Date of Patent: *Jan. 24, 2012**

(54) ROOFING SHINGLE WITH A LAYING LINE

(75) Inventors: Randal J. Jolitz, Joplin, MO (US); Dennis Dean Carlson, McPherson, KS (US); Charles Doyle Ziulkowski, Carl Junction, MO (US)

(73) Assignee: Tamko Building Products, Inc., Joplin, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/752,723

(22) Filed: Apr. 1, 2010

(65) Prior Publication Data

US 2010/0186312 A1 Jul. 29, 2010

Related U.S. Application Data

(60) Division of application No. 12/401,778, filed on Mar. 11, 2009, now Pat. No. 7,882,677, which is a continuation of application No. 11/319,827, filed on Dec. 28, 2005, now Pat. No. 7,516,593, which is a division of application No. 10/387,606, filed on Mar. 13, 2003, now Pat. No. 7,475,516, which is a continuation-in-part of application No. 10/357,685, filed on Feb. 4, 2003, now abandoned.

(51) Int. Cl.
*E04D 1/00* (2006.01)
*E04D 1/12* (2006.01)
*E04D 1/14* (2006.01)

(52) U.S. Cl. ..... 52/518; 52/525; 52/105; 52/557; 52/554; 52/553

(58) Field of Classification Search ..... 52/518, 52/525, 105, 557, 554, 553, DIG. 16, 749.12, 52/555, 543, 420, 519, 546, 549, 746.11, 52/747.1, 748.1
See application file for complete search history.

(56) References Cited

U.S. PATENT DOCUMENTS

| | | | | | |
|---|---|---|---|---|---|
| 1,159,766 | A | * | 11/1915 | Heppes | 52/519 |
| 1,389,979 | A | | 9/1921 | Rahr et al. | |
| 1,398,250 | A | | 11/1921 | Yetter | |
| 1,417,513 | A | | 5/1922 | Geyer | |
| 1,417,641 | A | | 5/1922 | Stuffings | |
| 1,424,459 | A | | 8/1922 | Ford | |
| 1,425,992 | A | | 8/1922 | Lesher | |
| 1,491,015 | A | * | 4/1924 | McFarland | 52/105 |
| 1,495,070 | A | | 5/1924 | Finley | |
| 1,582,281 | A | | 4/1926 | Kridler et al. | |
| 1,601,731 | A | | 10/1926 | Flood | |
| 1,604,708 | A | * | 10/1926 | Mills, Jr. | 52/555 |

(Continued)

*Primary Examiner* — Phi Dieu Tran A
(74) *Attorney, Agent, or Firm* — Husch Blackwell LLP

(57) ABSTRACT

A roofing shingle with a laying line that facilitates the alignment of an overlying course of shingles with respect an underlying course of shingles is provided. The laying line is located on a front surface of the shingle and has a width such that the laying line is exposed when an edge of another shingle is placed in contacting proximity with the laying line. The shingle may also have a scale and one or more nibs that protrude from the sides of the shingle that assist in aligning the shingles in the second course with the shingles in the underlying course. The shingle may also include nailing zones located on the front surface of the shingles provide a location for fastening the shingles to the roof. A method of laying the shingles of the present invention on a roof is also provided.

14 Claims, 8 Drawing Sheets

U.S. PATENT DOCUMENTS

| | | | | | |
|---|---|---|---|---|---|
| 1,633,474 | A | | 6/1927 | Busha | |
| 1,648,692 | A | | 11/1927 | McCarthy | |
| 1,668,269 | A | | 5/1928 | Faison | |
| 1,741,403 | A | | 12/1929 | Caton | |
| 1,741,566 | A | * | 12/1929 | Harris | 52/105 |
| 1,860,180 | A | | 5/1932 | Horne | |
| 2,013,351 | A | | 9/1935 | Levin | |
| 2,171,010 | A | | 8/1939 | Schuetz et al. | |
| 2,411,308 | A | | 11/1946 | Washburn | |
| 3,050,908 | A | | 8/1962 | Schenk | |
| 3,138,897 | A | * | 6/1964 | McCorkle | 52/420 |
| 3,919,823 | A | | 11/1975 | Bradley | |
| 3,927,501 | A | | 12/1975 | Allen et al. | |
| 3,964,219 | A | | 6/1976 | Hala | |
| 3,973,369 | A | | 8/1976 | Smith | |
| 4,333,279 | A | | 6/1982 | Corbin et al. | |
| 4,466,226 | A | | 8/1984 | Rohner | |
| 4,468,909 | A | | 9/1984 | Eaton | |
| D277,411 | S | | 1/1985 | Spinelli et al. | |
| 4,499,702 | A | | 2/1985 | Turner | |
| 4,628,661 | A | | 12/1986 | St. Louis | |
| 4,787,190 | A | | 11/1988 | Papsdorf | |
| 4,927,696 | A | | 5/1990 | Berg | |
| 5,060,431 | A | | 10/1991 | MacLeod et al. | |
| 5,174,092 | A | | 12/1992 | Naden | |
| 5,381,900 | A | | 1/1995 | Marra | |
| 5,743,059 | A | | 4/1998 | Fitfield | |
| 5,791,112 | A | | 8/1998 | Plum | |
| 5,799,459 | A | | 9/1998 | Covert | |
| 5,916,103 | A | | 6/1999 | Roberts | |
| 5,924,213 | A | | 7/1999 | Lee | |
| 5,946,877 | A | | 9/1999 | Gallinat et al. | |
| 6,164,034 | A | | 12/2000 | Roetheli et al. | |
| 6,338,230 | B1 | | 1/2002 | Davey | |
| 6,516,572 | B1 | | 2/2003 | Nowacek et al. | |
| 6,526,710 | B1 | | 3/2003 | Killen | |
| 6,526,717 | B2 | | 3/2003 | Waggoner et al. | |
| 6,539,643 | B1 | | 4/2003 | Gleeson | |
| 6,684,587 | B2 | | 2/2004 | Shaw et al. | |
| 2001/0022055 | A1 | * | 9/2001 | Zhang | 52/309.1 |

* cited by examiner

ROOFING SHINGLE WITH A LAYING LINE

CROSS-REFERENCE TO RELATED APPLICATIONS

This application is a divisional of and claims priority to the U.S. patent application Ser. No. 12/401,778, filed Mar. 11, 2009 now U.S. Pat. No. 7,882,677, which is a continuation of U.S. patent Ser. No. 11/319,827 filed Dec. 28, 2005 U.S. Pat. No. 7,516,593, issued Apr. 14, 2009, which is a divisional of U.S. patent Ser. No. 10/387,606 filed Mar. 13, 2003 U.S. Pat. No. 7,475,516, issued Jan. 13, 2009, which is a continuation-in-part of U.S. application Ser. No. 10/357,685 filed on Feb. 4, 2003, now abandoned, which documents are hereby incorporated by reference to the extent permitted by law.

BACKGROUND OF THE INVENTION

The present invention relates to a roofing shingle. More particularly, the present invention relates to a roofing shingle having a laying line that allows for proper positioning of multiple courses of shingles relative to one another, as well as proper spacing between the shingles on the same course.

The use of roofing shingles for protecting a roof is well known. Some man-made roofing products, such as composite slates, have been manufactured to resemble natural slate roofing. These man-made composite slate products may be a desirable alternative to natural slates given the fact that they are, in some cases, light weight, inexpensive and easy to apply. In addition, it is sometimes easy to control the color, weight, size and durability of man-made slates.

Installing composite slate roofing products on a roof begins with covering the roof deck with a waterproof underlayer. The slates are then placed on top of the waterproof underlayer and attached to the roof deck in rows or courses. In an effort to facilitate the process of fastening the slates to the roof deck, indentations or holes have been formed in composite slate products. In some cases, the indentations or holes may require an extra manufacturing step beyond the molding and/or cutting of the slate product, which may cause delays in manufacturing the slate product and increase production costs.

As best seen in FIG. 1, reference numeral 10 illustrates a prior art composite slate roofing product. In particular, composite slate roofing product 10 includes a thin laying line 12 positioned on a front surface 14, and a pair of nibs 16 that protrude from the left and right edges 18, 20 of roofing product 10. In addition, a shortened scale 22 includes a plurality of scale marks that extend inwardly from left edge 18, where one or more of scale marks may be labeled with numbers. For example, if scale mark 24 is labeled with the number "7", and scale mark 24 is aligned with a top edge of an underlying roofing product, this would indicate that 7 inches of the butt portion of the underlying product will be exposed. Further, a pair of nail holes 26 may be formed in composite slate roofing product 10 at a position below the lower-most nibs 16.

The composite slates described above have been manufactured with very thin laying lines for purposes of aligning the numerous courses of slates on the roof relative to one another. For instance, a first course of shingles is first laid on the roof with thin laying line 12 located on front surface 14. A second course of shingles is then laid on top of the first course of shingles by placing either left edge 18 or right edge 20 directly atop or closely adjacent to the underlying thin laying line 12. The next shingle in the second course is generally laid next to the first shingle in the second course. This process continues until the second course of shingles extends to both edges of the roof. In the case where the composite slates do not include a thin laying line, horizontal and vertical lines are typically chalked on the waterproof underlayer to guide the application of the slates on the roof.

Despite the use of the aforementioned alignment guides, the application and alignment of shingles remains problematic. For example, the use of a thin laying line causes alignment problems when laying the second course of shingles on the roof. Specifically, the first shingle in the second course often covers up the entire laying line established by the first course when laid on top of the first course. By covering the entire laying line with the first shingle laid in the second course (or even after laying the first few shingles), the frame of reference for laying subsequent shingles in the second course then becomes the forward edge of the second course shingle. Therefore, it is very difficult to ensure that subsequent shingles laid in the second course are being properly positioned and aligned with the first course of shingles.

Accordingly, there exists a need for a roofing shingle that provides an adequate and convenient alignment guide for laying subsequent courses of shingles on a roof. The present invention fills these needs as well as other needs.

BRIEF SUMMARY OF THE INVENTION

In order to overcome the above stated problems and limitations there is provided a roofing shingle having a laying line with a width that facilitates the application of a second course of shingles on top of an underlying course of shingles. The wide laying line helps to provide a guide that allows for proper spacing between each of the shingles on the second course, while ensuring that the second course of shingles is properly aligned relative to the underlying course of shingles.

In general, the laying line is located on a front surface of the roofing shingle that has a width defined by a near edge and a far edge such that the laying line is exposed when an edge of another roofing shingle is placed in contacting proximity with the near edge of the laying line. In particular, the laying line may be oriented lengthwise on the front surface of the shingle and may be at least about ⅛ inches thick.

Additionally, the roofing shingle may also have nibs that protrude from right and left sides of the shingle that assist in aligning the shingles in the second course with the shingles in the underlying course. The roofing shingle of the present invention also may have one or more scales positioned on the front surface thereof for vertically positioning the shingles in the second course with respect to the shingles in the underlying course. In addition, the scales may also be used to facilitate the alignment of the shingles in the second course when used in conjunction with the nibs in the present invention. Furthermore, the roofing shingle may also include indented or non-indented fastening zones located on the front surface of the shingles provide a location for fastening the shingles to the roof.

A method for applying the roofing shingles of the present invention to a roof is also provided. The method includes providing an underlying shingle having front surface with a laying line positioned thereon, providing an overlying shingle which includes a laying edge, coupling the underlying shingle to the roof to form at least a portion of the first course, laying the overlying shingle on at least a portion of the underlying shingle so that the leading edge of the overlying shingle is positioned in contacting proximity with the near edge of the laying line of the underlying shingle, and coupling the overlying shingle to the roof and wherein the laying line has near and far edges and is of a sufficient width such that the laying line is exposed when an edge of the overlaying shingle is placed in contacting proximity with the laying line of the underlying shingle.

Further, the method may also provide a scale positioned on the overlying shingle where at least a portion of the scale is aligned with a top edge of the underlying shingle prior to coupling the overlying shingle to the roof. The overlying shingle may also include a pointed nib that protrudes from the forward edge of the overlying shingle and is positioned so that it extends to the far edge of the laying line and, depending on the amount of the underlying shingle to be exposed, is aligned with a top edge of the underlying shingle. In addition, non-indented nailing zones may be positioned on the front surface of the overlying shingle to provide a location to couple the overlying shingle to the roof.

The overlying shingle may also include a scale and offset nibs on its trailing edge (offset from the nibs on the leading edge). Accordingly, in laying the second, third, fourth and subsequent shingles in the second course, the scale on the leading edge of the preceding coupled second course shingle is aligned with a corresponding scale marking on its trailing edge of the next second course shingle and with the leading edge of the same shingle contacting the near edge of the underlying laying line with the forward scale marking aligned with the upper edge of the underlying shingle.

Additional objects, advantages and novel features of the present invention will be set forth in part in the description which follows, and will in part become apparent to those in the practice of the invention, when considered with the attached figures.

BRIEF DESCRIPTION OF THE SEVERAL VIEWS OF THE DRAWINGS

The accompanying drawings form a part of the this specification and is to be read in conjunction therewith, wherein like reference numerals are employed to indicate like parts in the various views, and wherein.

DETAILED DESCRIPTION OF THE INVENTION

Figure 1:
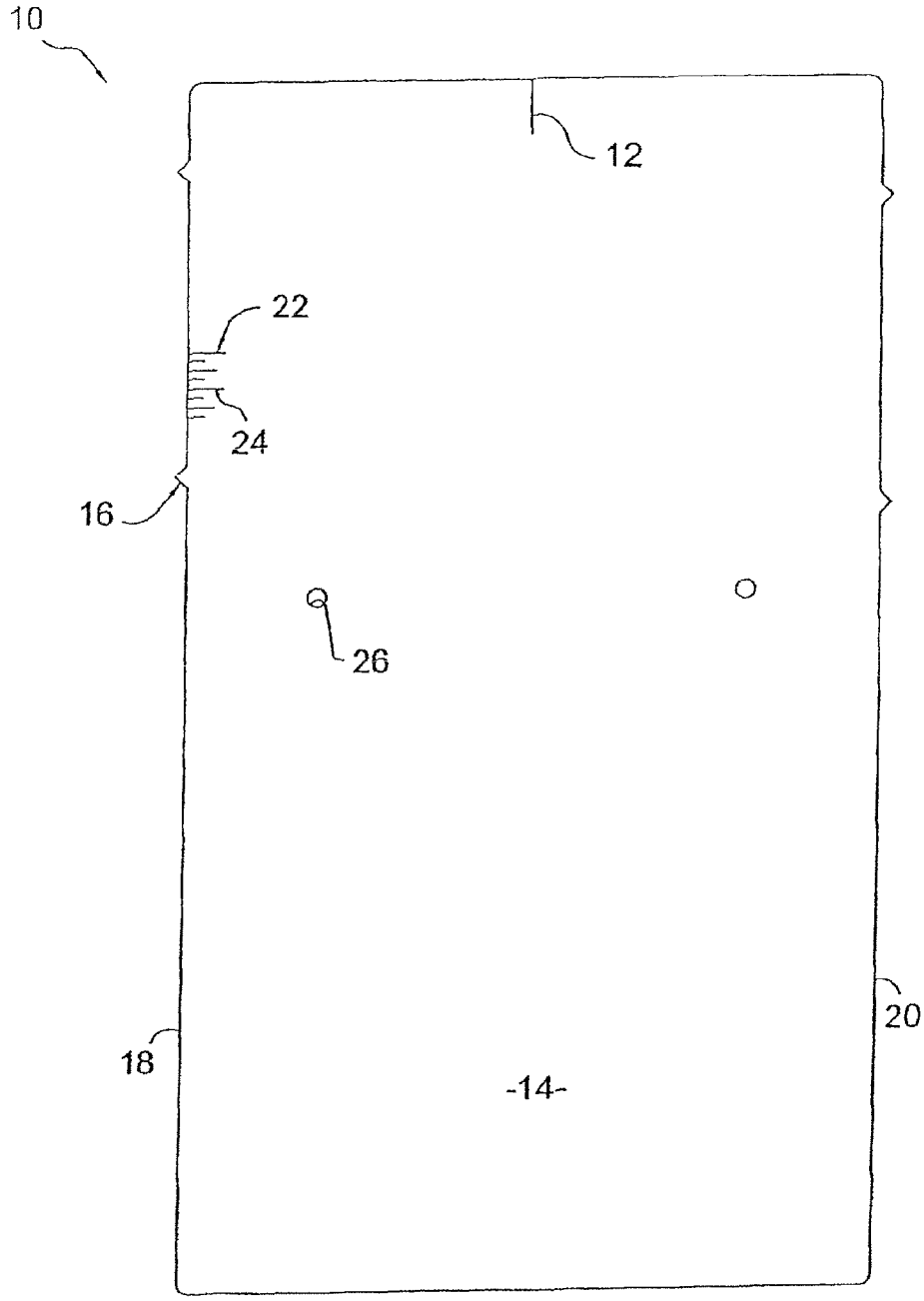
FIG. 1. PRIOR ART
FIG. 1 is a plan view of a prior art composite roofing product.
Figure 2:
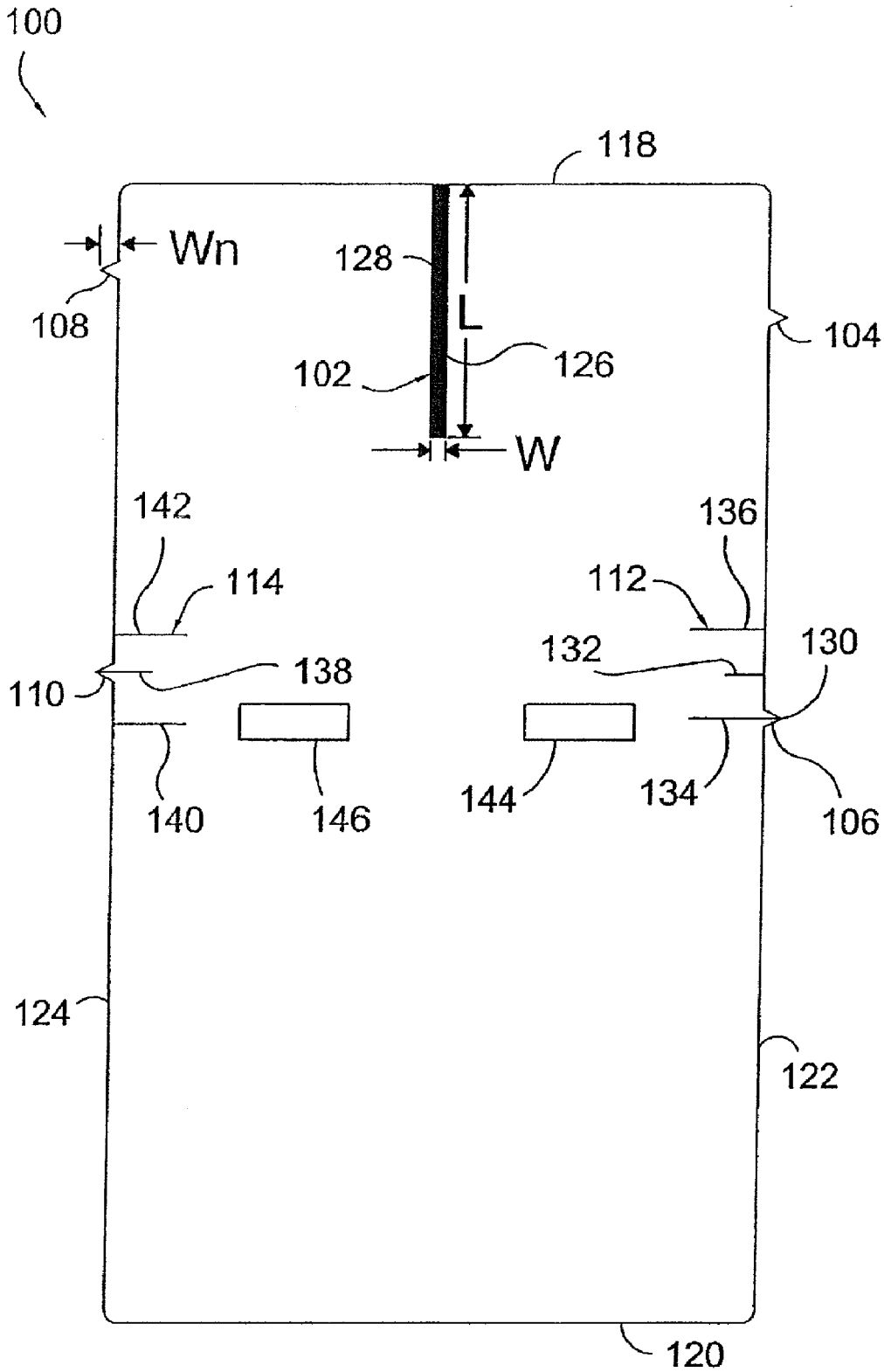
FIG. 2 is a plan view of a roofing shingle constructed in accordance with the present invention.

Referring now to the drawings in detail, and initially to FIG. 2, reference numeral 100 generally designates a roofing product or shingle constructed in accordance with the present invention. In general, shingle 100 includes a laying line 102 having a width such that laying line 102 is exposed when the edge of an overlying shingle in a subsequent course is placed in contacting proximity with the edge of laying line 102. Laying line 102 may be used for the proper positioning and alignment of an overlying or second course of shingles with respect to an underlying or first course of shingles. In addition, shingle 100 may include a plurality of nibs 104, 106, 108, 110 that may be used in conjunction with laying line 102 to assist in aligning multiple courses of shingles on a roof. A pair of scales 112, 114 may also be included on shingle 100 to provide a measuring tool that corresponds to the amount that the first course of shingles will be exposed when laying the second course of shingles are laid on top of the first course. It will be understood that shingle 100 may be configured to resemble a slate roofing product, asphalt shingles or any other type of roofing product.

As best seen in FIG. 2, shingle 100 includes a front surface 116 that is defined by a top edge 118, a lower edge 120, a right side 122 and a left side 124. It will be understood and appreciated that right and left sides 122, 124 may also be referred to as a leading edge or trailing edge depending on the direction the shingles are being laid on the roof (i.e., right to left, or left to right).

Laying line 102 is located on front surface 116 and includes a right edge 126 and a left edge 128. The right and left edges 126, 128 of laying line 102 may also be referred to as a near edge and a far edge depending on the direction the shingles are being laid on the roof. In addition, laying line 102 may extend downwardly from top edge 118 to a length indicated by the letter "L". A suitable length L for laying line 102 may be any length that is equal to or less than the entire length of the non-exposed portion of shingle 100. The non-exposed portion is the amount of shingle 100 that is covered by the second course of shingles that are laid on top of shingle 100. For example, suitable lengths L may vary from 1 to 6 inches and in certain circumstances could be longer. It is also within the scope of the present invention to provide a laying line that is slightly raised or elevated from front surface 116, or colored so as to contrast with the remainder of the shingle surface.

Furthermore, laying line 102 has a width indicated by the letter "W" that has an adequate thickness so that laying line 102 is exposed when the edge of an overlying shingle is placed in contacting proximity, or aligned, with either right or left edge 126, 128. For example, a suitable width W for laying line 102 may be at least about ⅛ inches, but it will be understood that other widths such as, but not limited to, 3/16 inches and ¼ inches are also within the scope of the present invention. It will be understood that the term "exposed" should be interpreted as meaning "visibly exposed" and "non-visibly exposed."

Shingle 100 may also include nibs 104, 106 extending from right side 122 and nibs 108, 110 extending from left side 124. In particular, each of nibs 104, 106, 108, 110 may generally include an apex or pointed end 130 that extends outwardly from right and left sides 122, 124, respectively, at a distance designated by $W_n$. It will be understood that the widths $W_n$ of nibs 104, 106, 108, 110 may be preferably equal. Nibs 108, 110 may be spaced apart at generally the same distance that separates nibs 104, 106. Nibs 104, 106 located on right side 122 may be staggered lower than nibs 108, 110 located on left side 124. It is also within the scope of the present invention to stagger nibs 104, 106 higher than nibs 108, 110. Further, $W_n$ may be less than, greater than, or equal to W in the present invention. Moreover, shingle 100 may include more than two nibs on each side, a single nib on each side, or no nibs extending from either right or left side 122, 124.

Scales 112, 114 are located on front surface 116 and extend inwardly from right and left sides 122, 124, respectively. Scale 112 includes a center tick 132, a lower tick 134 that is positioned below center tick 132, and an upper tick 136 that is position above center tick 132. Similarly, scale 114 includes a center tick 138, a lower tick 140 that is positioned below center tick 138, and an upper tick 142 at is position above center tick 138. Specifically, lower tick 134 extends from apex 130 of nib 106 and is aligned with lower tick 140. Center tick 138 extends inwardly from apex 130 of nib 110 and is aligned with center tick 132. Also, upper ticks 136, 142 are aligned with one another. Each tick may be assigned a number that corresponds to the amount that an underlying shingle will be exposed when the tick mark is aligned with the top edge of the underlying shingle. For instance, ticks 134, 140 may be assigned a number "8", which would indicate that 8 inches, or any other unit of measurement, of an underlying shingle would be exposed if ticks 134, 140 were aligned with the top edge of the underlying shingle. It will be understood that it is also within the scope of the present invention for shingle 100 not to include scales 112, 114.

Shingles 100 also may include a pair of indented or non-indented nailing zones 144, 146 located on front surface 116. Nailing zones 144, 146 are areas in which shingle 100 can be fastened to a roof through by using a nail, adhesive or any other suitable method or device. Nailing zones 144, 146 are generally positioned on front surface 116 so that shingle 100 will be adequately secured to the roof, and also so that the nailing zones 144, 146 are covered by an overlaying shingle. While nailing zones 144, 146 are shown as rectangles, it will be understood that other shapes may be implemented in the present invention.

In manufacturing shingle 100, laying line 102 may be applied to front surface 116 using any suitable method. For instance, if a molding process is used to form shingle 100, laying line 102 may be a part of the mold so that laying line 102 may be pressed into, embossed on, or protrude from front surface 116. Alternatively, laying line 102 may also be embossed into front surface 116 using an embossing tool, such as an embossing wheel, that is part of a sheet line process from making shingles. Other methods of applying laying line 102 to shingle 100, regardless of whether shingle 100 is man-made, such as a composite, or natural include, but are not limited to, painting, using a pressure sensitive or heat-sensitive adhesive, marking with a marker, pen, or chalk or taping. Typically, the method of applying laying line 102 is at least in part dictated by the type of material to which laying line 102 is applied. Nailing zones 144, 146 may also be applied to front surface 116 using any of the methods described above. It will be understood and appreciated that any suitable method for applying the laying line may be used in the present invention.

Shingle 100 may either be natural or man-made. Man-made versions of shingle 100 may include any suitable material such as, but not limited to, rubber (e.g., ground up tire rubber), polymers such as polyethylene (e.g., various grades, recycled or virgin), fillers (e.g., glass, stone, limestone), asphalt embedded mats, tile, or any other suitable composition. Further, natural versions of shingle 100 may be made of stone, slate, wood, or any other suitable material. On the other hand, natural versions of shingle 100 may be cut to shape using know techniques. In addition, man-made versions of shingle 100 may be made and cut, or molded, to shape using known techniques.

For example, one manner of making a composite version of shingle 100 is through the use of a combination mixer and extruder. The ingredients that are used to form shingle 100 are first mixed in the mixer, and then passed through the extruder. A pelletizer may be coupled to the extruder to create pellets from the composite mixture. The pellets are then fed into an injection molding machine, which operates to reheat the pellets into a molten state. The molten mixture may then be fed in any suitable manner into one or more molds that have been cast or machined, such as by digitized molding, to have the desired shape of the composite roofing product. After the shingle has been molded and allowed to cool, it may be removed from the mold, bundled with other shingles or roofing products, and stored for later sale and use. Many other methods of making composite versions of shingles 100 are also within the scope of the present invention.

The dimensions of shingle 100 may be altered depending at least in part upon the application for which shingles 100 will be used. For example, shingle 100 may be ¼ inches thick, 12 inches wide and 18 inches long. In addition, at least a portion of front surface 116 may be formed to resemble slate, which may be accomplished by molding, cutting or otherwise forming one side of a man-made version of the shingle to simulate natural slate. Alternatively, a shingle with these dimensions may also be created using natural slate or other types of roofing products such as, but not limited to, shakes, slates, tiles, or shingles. It will be understood and appreciated that shingle 100 may have dimensions other than those set forth above.

Figure 3:
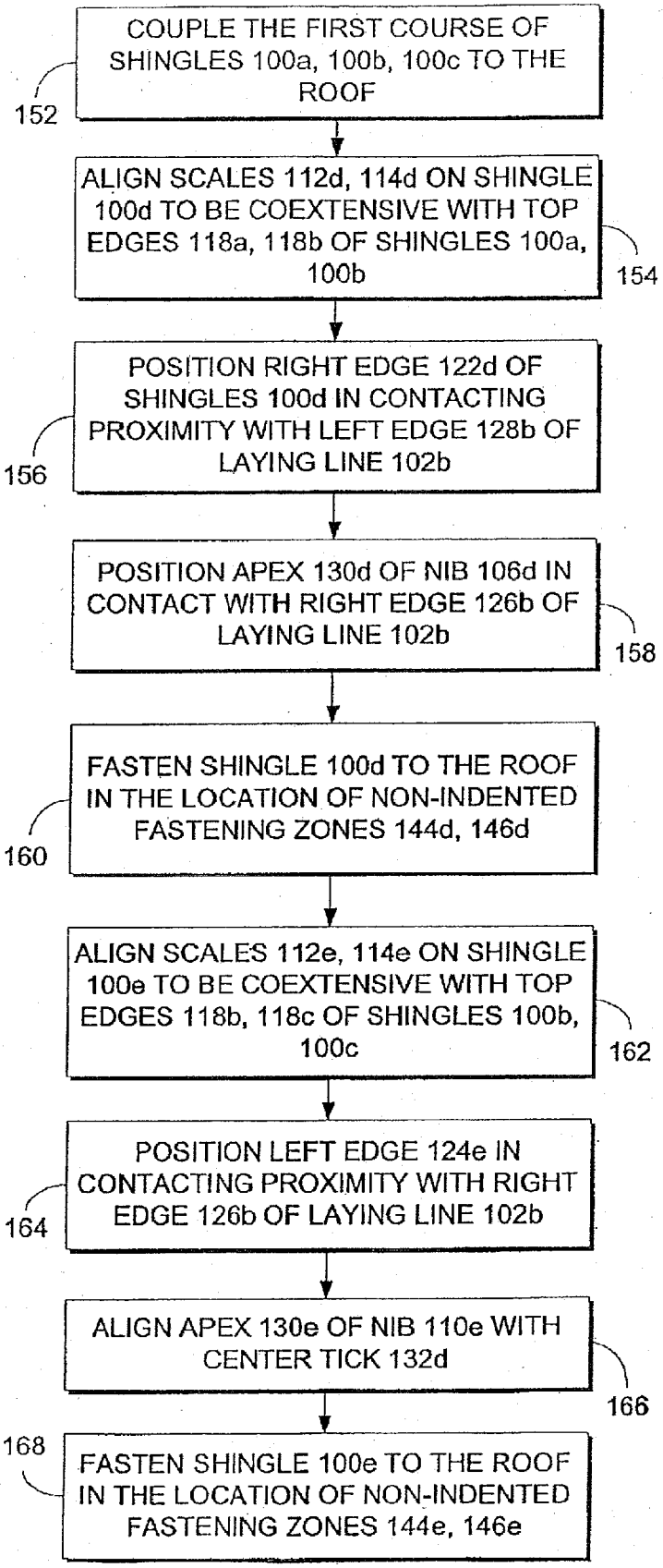
FIG. 3 is a flow chart describing a method of laying a first and second course of shingles using the shingles shown in FIG. 2.
Figure 4:
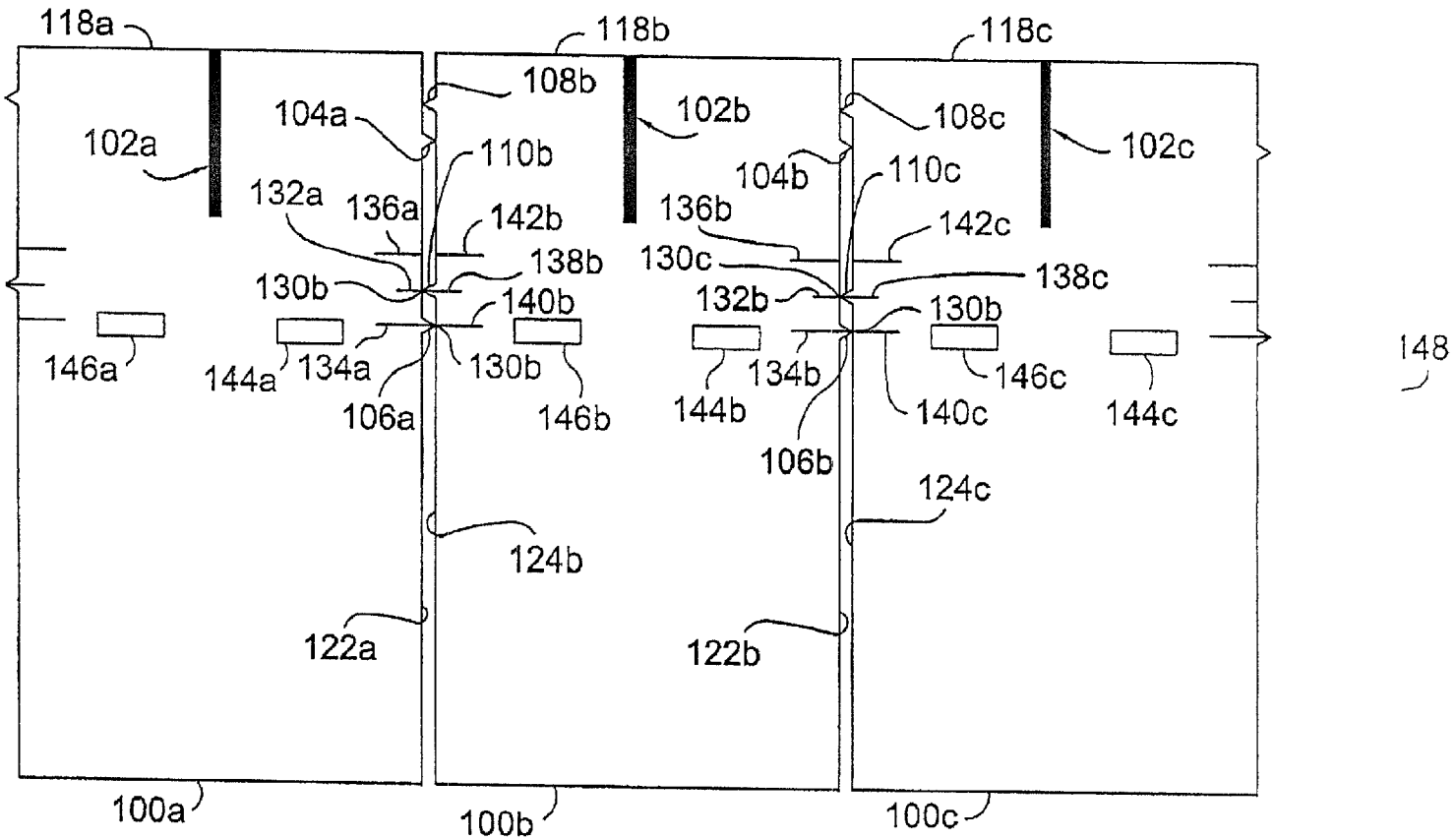
FIG. 4 is a plan view of the first course of shingles using the shingles shown in FIG. 2.

Shingles 100 constructed in accordance with the present invention may be used to form a roofing system, or at least a portion thereof. For instance, FIG. 3 illustrates one manner in which a first and second course of shingles 148, 150 may be laid on a roof. In particular, with additional reference to FIG. 4, first course of shingles 148 is laid on the roof and may include underlying shingles 100*a*, 100*b* and 100*c* as best seen in step 152. First, underlying shingle 100*a* may be laid into a desired position on the roof and then fixedly coupled thereto using a fastener in the location of non-indented nailing zones 144*a*, 146*a*. Next, underlying shingle 100*b* is placed adjacent to shingle 100*a* so that apex 120*a* of nib 106*a* and lower tick 134*a* are aligned with lower tick 140*b*, and upper tick 136*a* is aligned with upper tick 142*b*. Also, in placing shingle 100*b* near shingle 100*a*, apex 130*b* of nib 110*b* and center tick 138*b* is aligned with tick 132*a*. Further, nib 108*b* is in contact with leading edge 122*a* of shingle 100*a* and nib 104*a* is in contact with trailing edge 124*b*. The underlying shingle 100*b* is then fixedly coupled to the roof using a fastener in the location of non-indented nailing zones 144*b*, 146*b*. Shingle 100*c* is placed adjacent to shingle 100*b* so that apex 130*b* of nib 106*b* and lower tick 134*b* are aligned with lower tick 140*c*, and upper tick 136*b* is aligned with upper tick 142*c*. Further, apex 130*c* of nib 110*c* is aligned with tick 132*b*. In addition, nib 108*c* is in contact with leading edge 122*b* of shingle 100*b* and nib 104*b* is in contact with trailing edge 124*c*. Shingle 100*c* is then fixedly coupled to the roof using a fastener in the location of non-indented nailing zones 144*c*, 146*c*. The process for laying first course 148 may be repeated until the shingles extend to the edge of the roof. In addition, even though the above describes laying underlying shingles 100*a*, 100*b*, 100*c* from left to right, it will be understood that the shingles may also be laid from right to left using the same principles set forth above except that the leading edges will become trailing edges, and the trailing edges will become leading edges. Also, if the distance the nibs are positioned from the sides $W_n$ on underlying shingles 100*a*, 100*b*, 100*c* is less than the width of the laying line W, then shingles 100*a*, 100*b*, 100*c* should be spaced apart from one another at a distance about equal to the width of laying line W.

Figure 5:
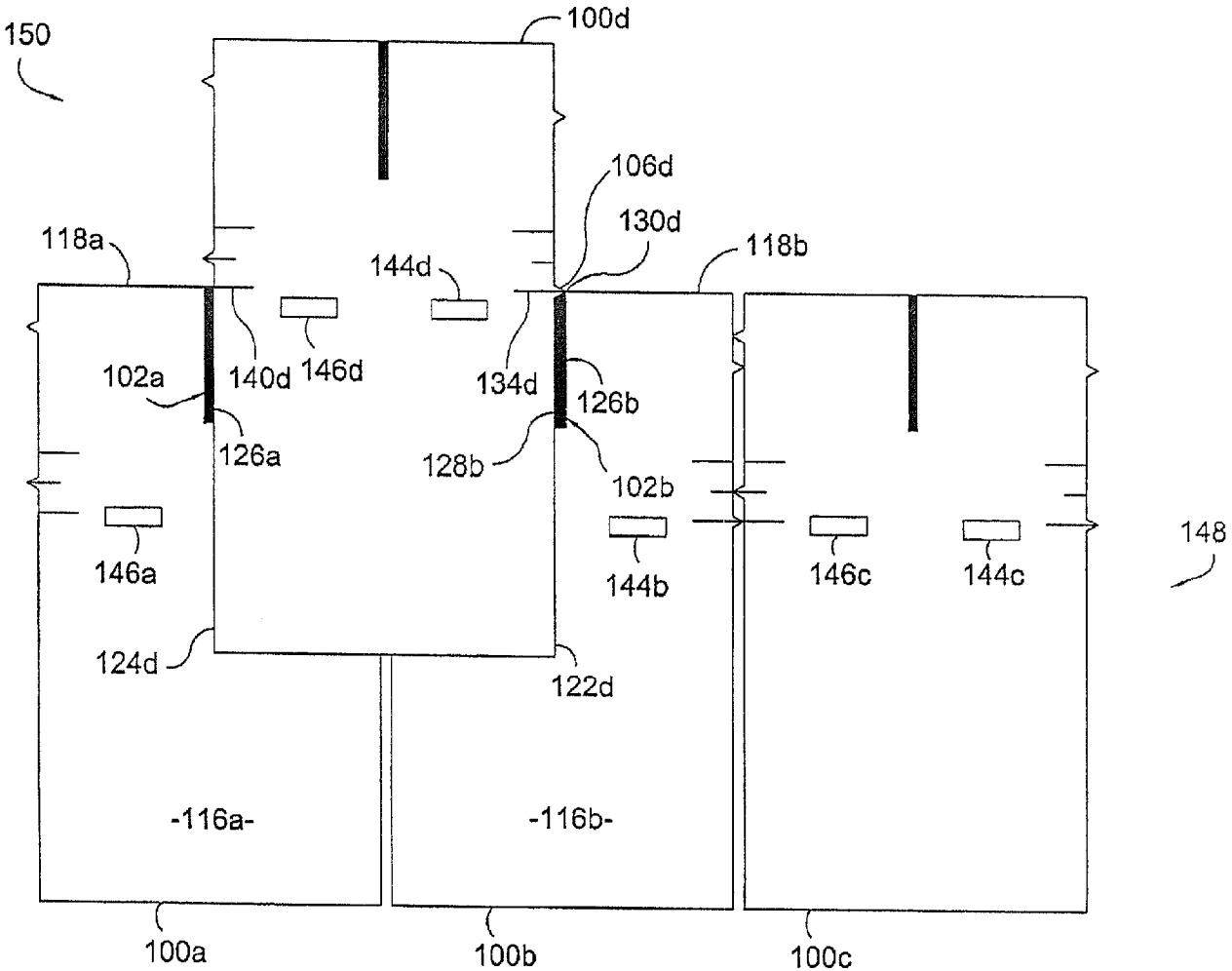
FIG. 5 is a plan view of a shingle shown in FIG. 2 overlying the first course of shingles to form the second course of shingles.
Figure 6:
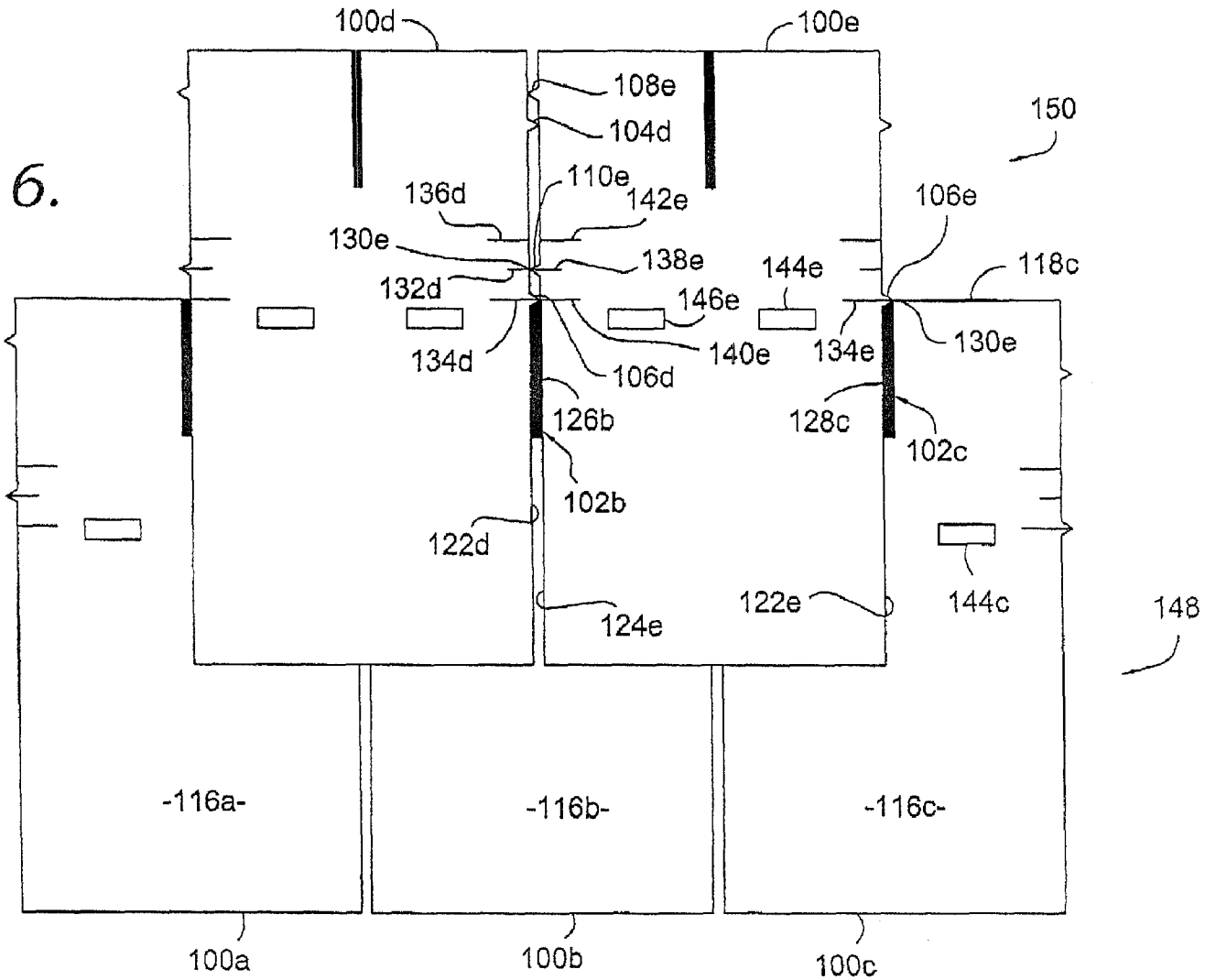
FIG. 6 is a plan view of a pair of shingles overlying the first course to form the second course of shingles.

Further, as best seen in FIGS. 3, 5 and 6, second course of shingles 150, which includes overlying shingles 100*d*, 100*e*, may then be mounted to the roof and positioned on top of a portion of first course 148. If second course 150 will be laid from left to right, the first step is to lay overlying shingle 100*d* on top of underlying shingles 100*a*, 100*b* as best seen in FIG.

5. In laying shingle 100*d*, one must ascertain the vertical positioning of shingle 100*d* with respect to shingles 100*a*, 100*b*, which requires the determination of how much of first course 148 will be exposed to an external environment. For instance, we will assume that 8 inches of shingle exposure is desired in this particular example. Thus, assuming that tick marks 134*d*, 140*d* are assigned a number "8", which represents the 8 inch mark, lower tick 140*d* is aligned to be coextensive with top edge 118*a* of shingle 100*a*, and lower tick 134*d* is aligned to be coextensive with top edge 118*b* of shingle 100*b* at step 154.

Next, the horizontal positioning of shingle 100*d* involves the use of laying lines 102*a*, 102*b* and nib 106*d*. Specifically, at step 156, leading edge 122*d* of shingle 100*d* is placed in contacting proximity with, or located adjacent to, near edge 128*b* of laying line 102*b* so that laying line 102*b* remains exposed. In addition, apex 130*d* of nib 106*d* is placed over laying line 102B and in contact with far edge 126*b* of laying line 102*b* at step 158. In general, if any portion of front surface 116*b* of shingle 100*b* is exposed between near edge 128*b* of laying line 102*b* and leading edge 122*d* of shingle 100*d*, other than laying line 102*b*, then shingle 100*d* has been misaligned. Trailing edge 124*d* of shingle 100*d* is also placed in contacting proximity with, or located adjacent to, far edge 126*a* of laying line 102*a* so that laying line 102*a* remains exposed. Once again, if any portion of front surface 116*a* of shingle 100*a* is exposed between far edge 126*a* of laying line 102*a* and trailing edge 124*d* of shingle 100*d*, other than laying line 102*a*, then shingle 100*d* has been misaligned. Once shingle 100*d* is properly aligned in accordance with the procedure describe above, shingle 100*d* is then fastened to the roof in the location of non-indented nailing zones 144*d*, 146*d* at step 160. It will be understood that in the case where the width $W_n$ of nib 106*d* is less than the width of laying line 102*b*, apex 130*d* of nib 106*d* will not extend to far edge 126*b*, but instead will be placed on top of laying line 102*b*.

In continuing to lay the second course 150, with particular reference to FIGS. 3 and 6, overlying shingle 100*e* is laid on a portion of underlying shingles 100*b*, 100*c*. In particular, assuming that tick marks 134*e*, 140*e* are assigned a number "8", which represents the 8 inch mark, lower tick 140*e* is aligned to be coextensive with top edge 118*b* of shingle 100*b*, and lower tick 134*e* is aligned to be coextensive with top edge 118*c* of shingle 100*c* at step 162.

The horizontal positioning of shingle 100*e* involves the use of laying lines 102*b*, 102*c* and nib 106*e*. Specifically, at step 164, trailing edge 124*e* of shingle 100*e* is placed in contacting proximity with, or located adjacent to, far edge 126*b* of laying line 102*b* so that laying line 102*b* remains exposed and fills a substantial portion of the space between shingles 100*d*, 100*e*. In addition, apex 130*e* of nib 110*e* and center tick 138*e* is aligned with center tick 132*d* at step 166. Further, top tick 142*e* is aligned with top tick 136*d*. Further, when the width $W_n$ of nibs 106*d*, 104*d*, 110*e*, 108*e* are equal to the width W of laying line, then nibs 108*e*, 110*e* will contact leading edge 122*d* of shingle 100*d*, and nibs 104*d*, 106*d* will contact trailing edge 124*e* of shingle 100*e*. If any portion of front surface 116*b* of shingle 100*b* is exposed between trailing edge 126*b* of laying line 102*b* and far edge 124*e* of shingle 100*e*, other than laying line 102*b*, then shingle 100*e* has been misaligned. Additionally, leading edge 122*e* of shingle 100*e* is also placed in contacting proximity with, or located adjacent to, near edge 128*c* of laying line 102*c* so that laying line 102*c* remains exposed. If any portion of front surface 116*c* of shingle 100*c* is exposed between near edge 128*c* of laying line 102*c* and leading edge 122*e* of shingle 100*e*, other than laying line 102*c*, then shingle 100*e* has been misaligned. Once shingle 100*e* is properly aligned, shingle 100*e* is then fastened to the roof in the location of non-indented nailing zones 144*e*, 146*e* at step 168. This method is continued until second course 150 is complete. It is also within the scope of the present invention to lay shingle 100*e* prior to shingle 100*d* thereby applying second course 150 from right to left on the roof.

Figure 7:
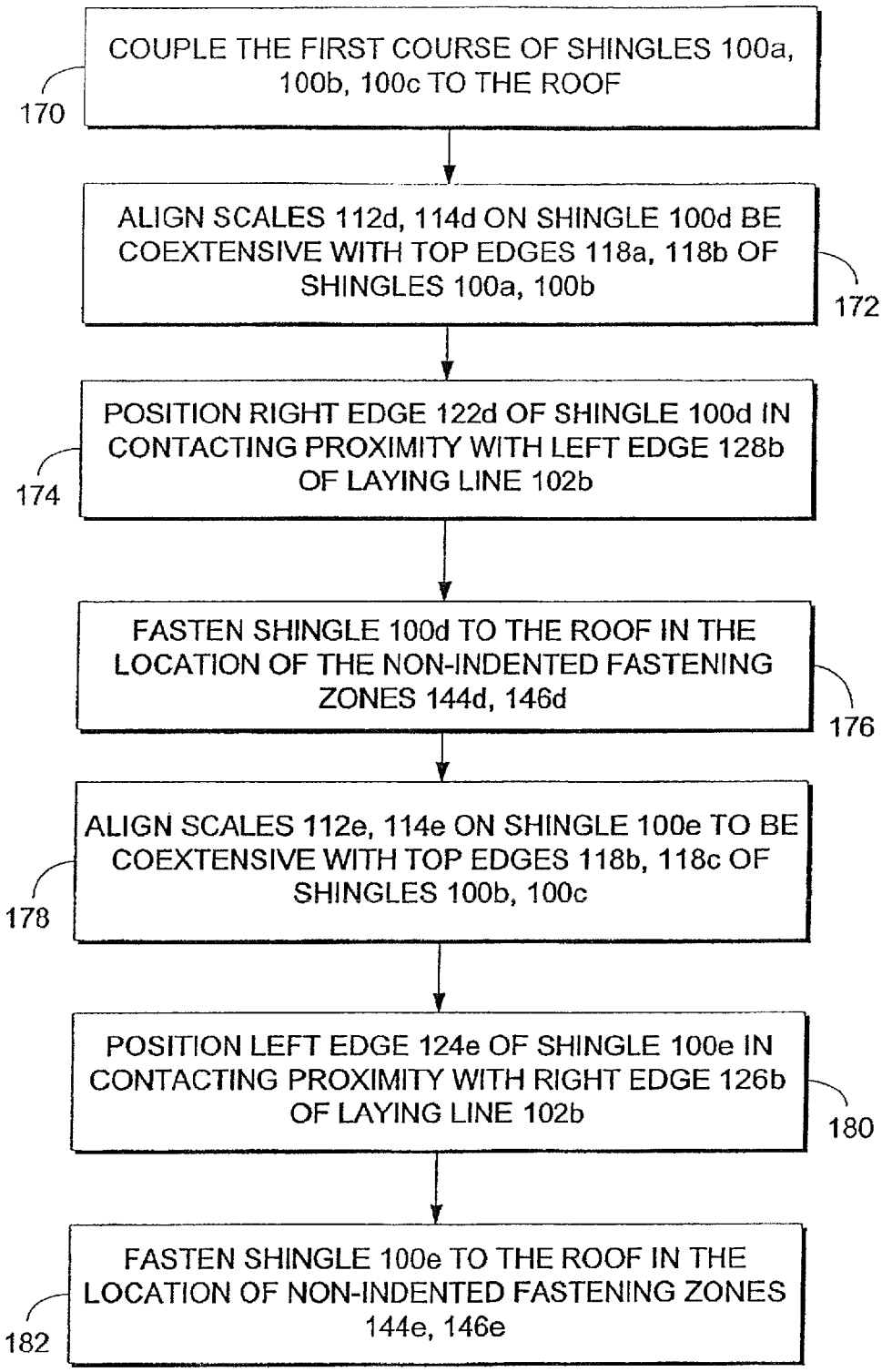
FIG. 7 is a flow chart describing a method of laying an alternative type of shingles that do not include nibs.
Figure 8:
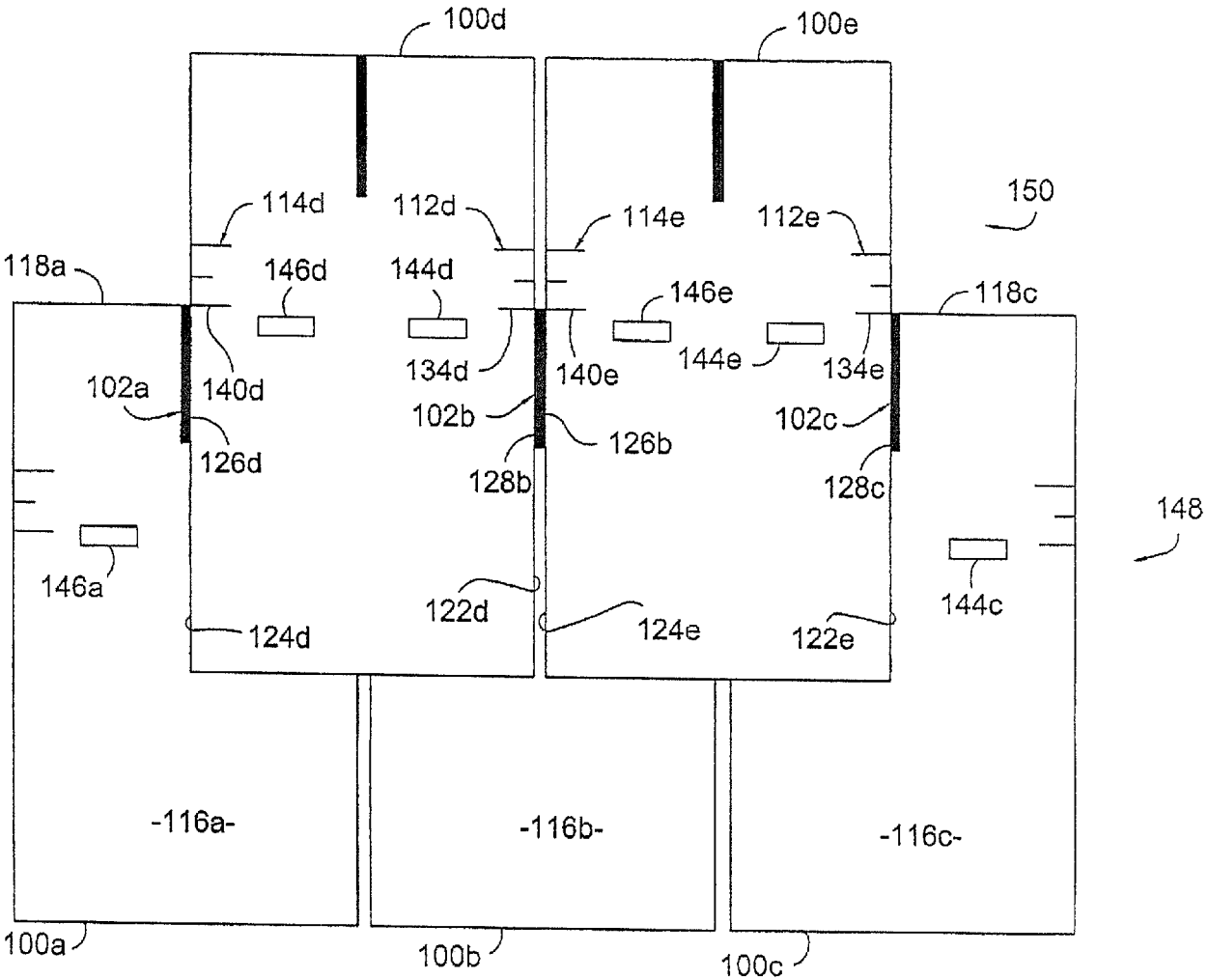
FIG. 8 is a plan view similar to FIG. 6 showing the first and second course of shingles without nibs.

As best seen in FIG. 7, it is also within the scope of the present invention to lay first and second course of shingles 148, 150 where one or more of the shingles do not have nibs extending from the right and left sides of the shingle. With additional reference to FIG. 8, underlying shingles 100*a*, 100*b*, 100*c* are first coupled to the roof to form first course 148 at step 170. In particular, shingle 100*a* may be laid into a desired position on the roof and then fixedly coupled thereto using a fastener in the location of non-indented nailing zones 144*a*, 146*a*. Next, shingle 100*b* is placed adjacent to shingle 100*a* at a distance that is equal to the width W of laying lines 102*a*, 102*b*, 102*c*. Shingle 100*b* is then fixedly coupled to the roof using a fastener in the location of non-indented nailing zones 144*b*, 146*b*. Shingle 100*c* is placed adjacent to shingle 100*b* at a distance that is equal to the width W of laying lines 102*a*, 102*b*, 102*c*. Shingle 100*c* is then fixedly coupled to the roof using a fastener in the location of non-indented nailing zones 144*c*, 146*c*. The process for laying first course 148 may be repeated until the shingles extend to the edge of the roof. Thus, shingles 100*a*, 100*b*, 100*c* should be spaced apart from one another at a distance about equal to the width W of laying lines 102*a*, 102*b*, 102*c*.

In continuing the example of the present invention where the shingles do not have nibs, overlying shingles 100*d*, 100*e* are then laid on top of first course 148 to form a second course 150. If second course 150 will be laid from left to right, the first step is to lay shingle 100*d* on top of shingles 100*a*, 100*b*. In laying overlying shingle 100*d*, one must ascertain the vertical positioning of shingle 100*d* with respect to shingles 100*a*, 100*b*, which requires the determination of how much of underlying shingles 100*a*, 100*b* will be exposed to an external environment. For instance, it will be assumed that 8 inches of shingle exposure is desired in this particular example. Thus, assuming that tick marks 134*d*, 140*d* are assigned a number "8", which represents the 8 inch mark, lower tick 140*d* is aligned to be coextensive with top edge 118*a* of shingle 100*a*, and lower tick 134*d* is aligned to be coextensive with top edge 118*b* of shingle 100*b*.

Next, the horizontal positioning of shingle 100*d* involves the use of laying lines 102*a*, 102*b*. Specifically, leading edge 122*d* of shingle 100*d* is placed in contacting proximity with, or located adjacent to near edge 128*b* of laying line 102*b* so that laying line 102*b* remains exposed. If any portion of front surface 116*b* of shingle 100*b* is exposed between near edge 128*b* of laying line 102*b* and leading edge 122*d* of shingle 100*d*, other than laying line 102*b*, then shingle 100*d* has been misaligned. Trailing edge 124*d* of shingle 100*d* is also placed in contacting proximity with, or located adjacent to, far edge 126*a* of laying line 102*a* so that laying line 102*a* remains exposed. If any portion of front surface 116*a* of shingle 100*a* is exposed between far edge 126*a* of laying line 102*a* and trailing edge 124*d* of shingle 100*d*, other than laying line 102*a*, then shingle 100*d* has been misaligned. Once shingle 100*d* is properly aligned above, shingle 100*d* is then fastened to the roof in the location of non-indented nailing zones 144*d*, 146*d*. The combination of scales 112*d*, 114*d* and laying shingle 100*d* with respect to laying lines 102*a*, 102*b* provides for proper vertical and horizontal alignment of shingle 100*d* with respect to shingles 100*a*, 100*b*.

In continuing to lay second course 150, overlying shingle 100*e* is laid on a portion of underlying shingles 100*b*, 100*c*. In particular, assuming that tick marks 134*e*, 140*e* are assigned a number "8", which represents the 8 inch mark, lower tick 140*e* is aligned to be coextensive with top edge 118*b* of shingle 100*b*, and lower tick 134*e* is aligned to be coextensive with top edge 118*c* of shingle 100*c*.

The horizontal positioning of overlying shingle 100*e* involves the use of laying lines 102*b*, 102*c*. Specifically, trailing edge 124*e* of shingle 100*e* is placed in contacting proximity with, or located adjacent to, far edge 126*b* of laying line 102*b* so that laying line 102*b* remains exposed and fills a substantial portion of the space between shingles 100*d*, 100*e*. If any portion of front surface 116*b* of shingle 100*b* is exposed between far edge 126*b* of laying line 102*b* and trailing edge 124*e* of shingle 100*e*, other than laying line 102*b*, then shingle 100*e* has been misaligned. Leading edge 122*e* of shingle 100*e* is also placed in contacting proximity with, or located adjacent to, near edge 128*c* of laying line 102*c* so that laying line 102*c* remains exposed. If any portion of front surface 116*c* of shingle 100*c* is exposed between near edge 128*c* of laying line 102*c* and leading edge 122*e* of shingle 100*e*, other than laying line 102*c*, then shingle 100*e* has been misaligned. Once shingle 100*e* is properly aligned, shingle 100*e* is then fastened to the roof in the location of non-indented nailing zones 144*e*, 146*e*. The combination of the scales 112*e*, 114*e*, and laying shingle 100*e* with respect to laying lines 102*b*, 102*c* provides for proper vertical and horizontal alignment of shingle 100*e* with respect to first course 148 and shingle 100*d*. This method is continued until second course 150 is complete. It is also within the scope of the present invention to lay shingle 100*e* prior to shingle 100*d* thereby applying second course 150 from right to left on the roof.

The present invention for a roofing shingle having a wide laying line overcomes or ameliorates the drawbacks and deficiencies in the prior art. Specifically, the wide laying line on the roofing shingle facilitates the application of a second course of shingles on top of an underlying course of shingles by providing a guide that allows for proper spacing between each of the shingles on the second course, while ensuring that the second course of shingles is properly aligned with the underlying course of shingles. In addition, the nibs used in conjunction with the laying line of the present invention make it easier to align the shingles in the second course with the shingles in the underlying course. Moreover, the scales in the present invention not only assist in vertically positioning the shingles in the second course with the shingles in the underlying course, but they also are used to facilitate the alignment of the shingles in the second course when used in conjunction with the nibs in the present invention. Furthermore, the non-indented nailing zones located on the front surface of the shingles provide a location for nailing the shingles to the roof without placing the shingles through the manufacturing process that exists in the prior art.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

We claim:

1. A roofing shingle of unitary construction comprising:

at least one first nib having a distal end and extending from a leading edge of said roofing shingle;

a laying line oriented lengthwise on a front surface of said shingle, said laying line being defined by a near edge and a far edge;

wherein said laying line is exposed when an edge of an overlying roofing shingle is placed in contacting proximity with said laying line; and wherein said nib has substantially the same width as said laying line, said nib being adapted for facilitating a space between adjacent shingles, said space having a width generally equal to the width of said laying line;

wherein said nib is sized and adapted such that when the leading edge of a first, overlying shingle is placed in contacting proximity with the far edge of the laying line of a second, underlying shingle, the end of said nib of said overlying shingle extends to the near edge of the laying line of said underlying shingle.

2. The roofing shingle of claim 1, wherein the width of the laying line is at least ⅛ inches.

3. The roofing shingle of claim 1, wherein at least a portion of said front surface is configured to resemble slate.

4. The roofing shingle of claim 1, said nib including an apex having a pointed end.

5. The roofing shingle of claim 4, said apex having a rounded end.

6. The roofing shingle of claim 1, further comprising a nailing zone on said front surface of said shingle.

7. The roofing shingle of claim 1, further comprising a scale on said front surface of said shingle.

8. The roofing shingle of claim 1, further comprising at least one second nib.

9. The roofing shingle of claim 8, wherein said second nib extends from a trailing edge of said shingle.

10. A plurality of assembled roofing shingles, each of said roofing shingles being of unitary construction and comprising:

at least one first nib having an apex and extending from a leading edge of said roofing shingle;

a laying line oriented lengthwise on a front surface of said shingle, said laying line being defined by a near edge and a far edge;

wherein said laying line is exposed when an edge of an overlying roofing shingle is placed in contacting proximity with said laying line; and wherein said nib has substantially the same width as said laying line, said nib being adapted for facilitating a space between adjacent shingles, said space having a width generally equal to the width of said laying line;

wherein said nib is sized and adapted such that when the leading edge of a first, overlying shingle is placed in contacting proximity with the far edge of the laying line of a second, underlying shingle, the apex of said nib of said overlying shingle extends to the near edge of the laying line of said underlying shingle.

11. The roofing shingle of claim 7, wherein said scale is associated with said nib.

12. The roofing shingle of claim 1, said shingle further including a trailing edge, wherein said nib is adapted such that when the leading edge of the overlying shingle is placed in contacting proximity with the far edge of the laying line of the underlying shingle, said nib of the overlying shingle is in contact with the trailing edge of the underlying shingle.

13. The roofing shingle of claim 1, wherein said nib is located such that a desired vertical alignment of the overlying shingle may be achieved by positioning the overlying shingle such that an apex of the nib of said overlying shingle is coextensive with a top edge of the underlying shingle.

14. The roofing shingle of claim 1, further comprising a scale having at least two intervally spaced markings on said front surface of said roofing shingle.

* * * * *